US005553731A

United States Patent [19]

Schuyler

[11] Patent Number: 5,553,731

[45] Date of Patent: Sep. 10, 1996

[54] ADAPTABLE CLOSURE FOR DRINKING CONTAINERS

[75] Inventor: Richard D. Schuyler, Beaverton, Oreg.

[73] Assignee: Starbucks Corporation, Seattle, Wash.

[21] Appl. No.: 451,745

[22] Filed: May 26, 1995

Related U.S. Application Data

[63] Continuation of Ser. No. 184,848, Jan. 21, 1994, abandoned.

[51] Int. Cl.[6] ..... A47G 19/22

[52] U.S. Cl. ..... 220/719; 220/713

[58] Field of Search ..... 220/703, 710.5, 220/711, 713, 719, 734, 578, 579, 580

[56] References Cited

U.S. PATENT DOCUMENTS

| | | | |
|---|---|---|---|
| D. 290,568 | 6/1987 | Feltman et al. . | |
| D. 333,067 | 2/1993 | Feltman, III . | |
| 1,254,251 | 1/1918 | Magnus . | |
| 1,739,627 | 12/1929 | Austin . | |
| 2,003,657 | 6/1935 | Stubblefield . | |
| 2,601,767 | 7/1952 | Wall | 220/713 X |
| 2,646,670 | 7/1953 | Spalding et al. . | |
| 2,761,301 | 9/1956 | Tellier . | |
| 2,765,639 | 10/1956 | Bryant . | |
| 2,828,886 | 4/1958 | Thomas | 220/579 |
| 3,184,126 | 5/1965 | Casull | 220/719 X |
| 3,360,161 | 12/1967 | Smith | 220/719 |
| 3,549,044 | 12/1970 | Lerner . | |
| 3,780,897 | 12/1973 | Wassilieff . | |
| 3,806,023 | 4/1974 | Barnett . | |
| 3,850,341 | 11/1974 | Bart . | |
| 3,915,355 | 10/1975 | Young . | |
| 4,243,156 | 1/1981 | Lobbestael . | |
| 4,394,922 | 7/1983 | Wimmer . | |
| 4,441,623 | 4/1984 | Antoniak . | |
| 4,625,883 | 12/1986 | Burke et al. | 220/578 |
| 4,723,674 | 2/1988 | Nunes | 220/580 X |
| 4,842,157 | 6/1989 | Stone-Parker et al. . | |
| 4,901,881 | 2/1990 | McElroy . | |
| 4,949,865 | 8/1990 | Turner . | |
| 5,062,552 | 11/1991 | Heubel . | |
| 5,102,000 | 4/1992 | Feltman, III . | |
| 5,143,248 | 9/1992 | Sawatsky . | |
| 5,253,780 | 10/1993 | Adado | 220/711 |

*Primary Examiner*—Jes F. Pascua

*Attorney, Agent, or Firm*—Christensen O'Connor Johnson & Kindness PLLC

[57] ABSTRACT

An adaptable closure for drinking containers is disclosed. The closure generally includes a concave disk having a central portion and a wide, angled flange. The flange extends upwardly and outwardly from the central portion around the periphery of the central portion. The flange has an upper surface and a lower surface and is flexible and resilient. The lower surface of the flange has the shape of an inverted frustum of a cone for sealingly engaging the inside surfaces of the drinking container. The closure includes a drinking hole offset from the center of the disk and a vent hole also offset from the center of the disk approximately opposite the drinking hole. Finger tabs are provided on the top of the disk to aid in removal of the closure from the drinking container.

13 Claims, 2 Drawing Sheets

ADAPTABLE CLOSURE FOR DRINKING CONTAINERS

This application is a continuation application based on prior application Ser. No. 08/184,848, filed on Jan. 21, 1994 now abandoned.

FIELD OF THE INVENTION

This invention relates to an adaptable closure for drinking containers and, more particularly, a removable closure that prevents spills.

BACKGROUND OF THE INVENTION

People often take their drinks with them when commuting or otherwise driving or walking place to place. Coffee drinkers, for example, have had to rely on a variety of coffee travel cups and disposable "to go" cups. The common generic plastic travel cups with attachable lids are convenient to use, but have several disadvantages. For example, plastic cups and lids are easily scratched, retain grime and dirt, develop permanent stain markings, and are difficult to clean due to being relatively deeper and narrower than average size cups. The attachable lids are not adaptable to a wide variety of cups and fit only one diameter.

The disposable Styrofoam and paper cups that have dominated the "coffee to go" market sold at convenience stores and fast-food restaurants are used once and discarded, creating waste and undue expense. The usual lids associated with Styrofoam and paper cups are commonly made of thin, molded plastic and offer no insulating protection from the hot beverages. This situation can result in difficulty drinking and handling that are especially hazardous in a moving vehicle.

Numerous drinking lids have been created to avoid spills. A patent to Magnus (U.S. Pat. No. 1,254,251) discloses a drinking lid for use with tapered cups or glasses. Specifically, the patent discloses a drinking lid constructed of a concave rubber disk, an enlarged bead formed around the rim of the disk, and notches formed in the outer projecting wall of the bead. However, the Magnus lid cannot adapt to seal the tops of mugs or glasses of differing diameters. The large bead around the Magnus lid causes it to be only minimally flexible. Thus, the acceptable range of container diameters is quite narrow if the lid is to fit within the top of the container. The lid must also be used with containers that taper toward the bottom of the container. Coffee mugs typically do not taper, however. The Magnus lid may also be difficult to remove from the drinking container. Also, the rubber material of which the Magnus lid is constructed may degrade over time and loose its resiliency. This could especially be a problem if the lid is subjected to heat or sunlight.

Other lids have been created that may be secured to the rim of a cup or glass. However, these lids can fit only one container diameter and may even require a specific rim thickness to properly seal.

Therefore, a one-piece drinking closure that is adaptable to a wide variety of drinking containers, such as ceramic coffee mugs, is desirable to allow the use of ceramic mugs and various other containers as travel cups.

SUMMARY OF THE INVENTION

An adaptable closure for drinking containers is disclosed. The closure prevents liquid spills from the container. The closure includes a generally concave disk that has both a central portion and an angled flange. The angled flange extends upwardly and outwardly from the central portion around the periphery of the central portion. The flange has a lower surface with the shape of an inverted frustum of a cone for sealingly engaging the inside surface of the drinking container. The flange is flexible and resilient such that containers of differing diameters and tapers may be used with the closure of the present invention. Preferably, the closure includes a drinking hole offset from the center of the disk. A vent hole also offset from the center of the disk and approximately opposite the drinking hole is also provided. Finger tabs are disposed on the top surface of the closure to aid the user in placement and removal of the closure from a drinking container. Preferably, the disk has a circular outer shape.

One embodiment of the container of the present invention includes a drink receptacle and a lid. The drink receptacle includes an inner sidewall. The lid is formed of a disk with flanges that sealingly engage the inner sidewall of the drink receptacle.

The embodiments of the present invention provide several advantages over the prior-art lids. The drinking container closure of the present invention is reusable and adaptable to ceramic cups and mugs of various sizes. The concave flexible design of the closure provides a tight seal just below the inside rim of the ceramic cup. The closure also conforms to nonconcentric or out-of-round vertical inner walls of a ceramic cup. The simple one-piece design of the closure enhances reliability, decreases cost, and increases sanitary cleansing because the closure is devoid of the normal hidden or partially hidden cavities.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
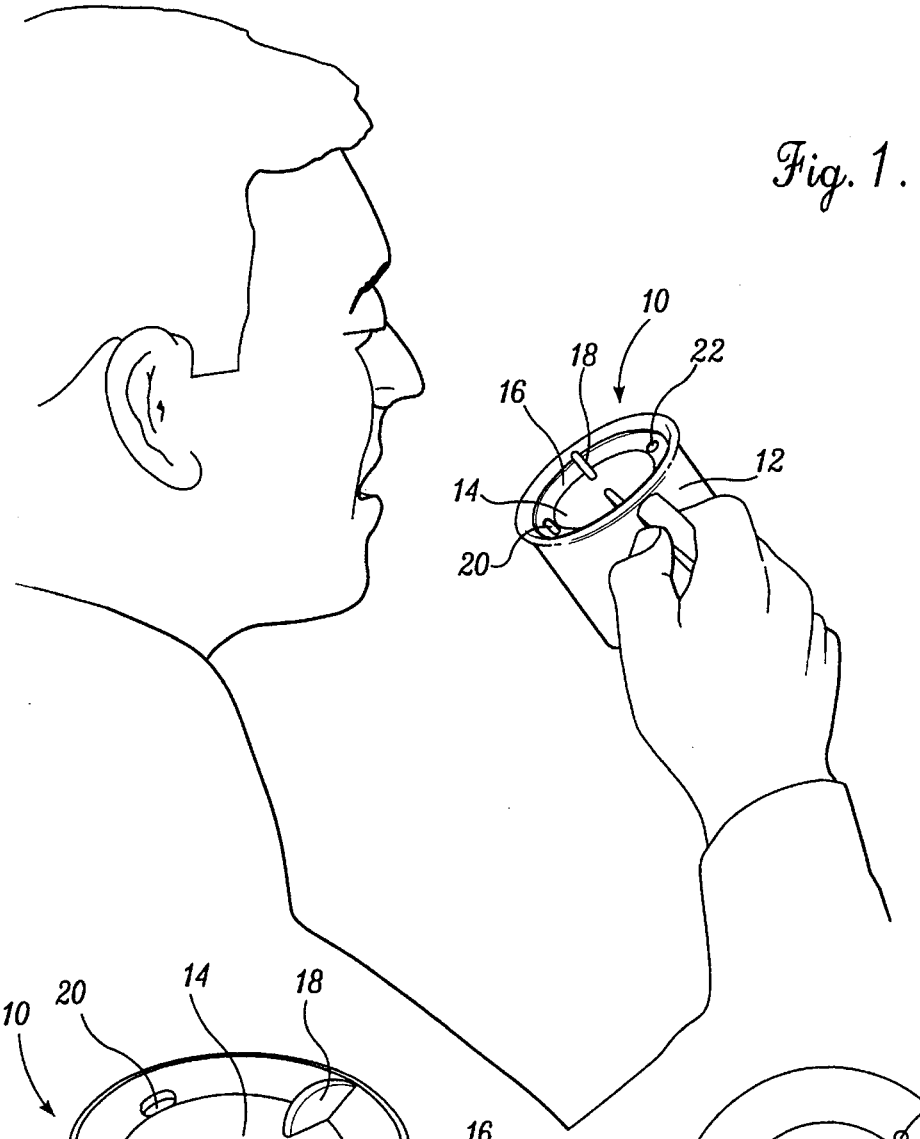
FIG. 1 is a perspective view of the lid of the present invention inserted within a mug.
Figure 2:
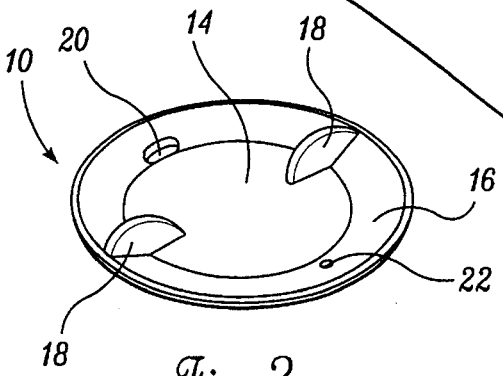
FIG. 2 is a perspective view of the lid of the present invention.
Figure 4:
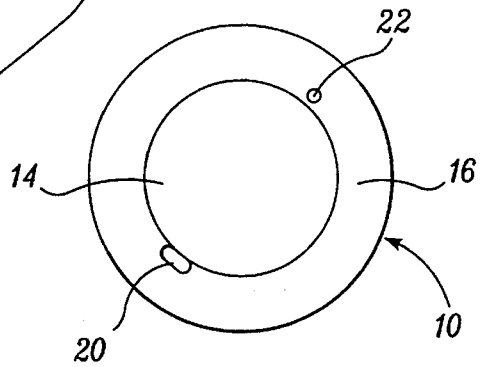
FIG. 4 is a bottom view of the lid.
Figure 3:
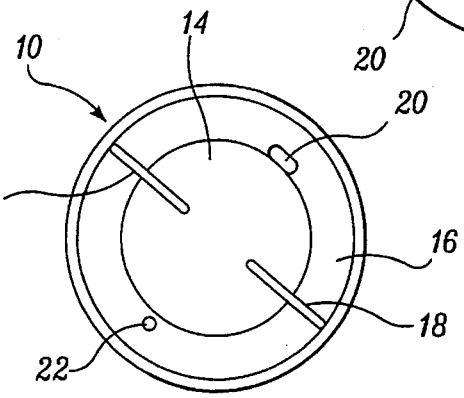
FIG. 3 is a top view of the lid.
Figure 5:
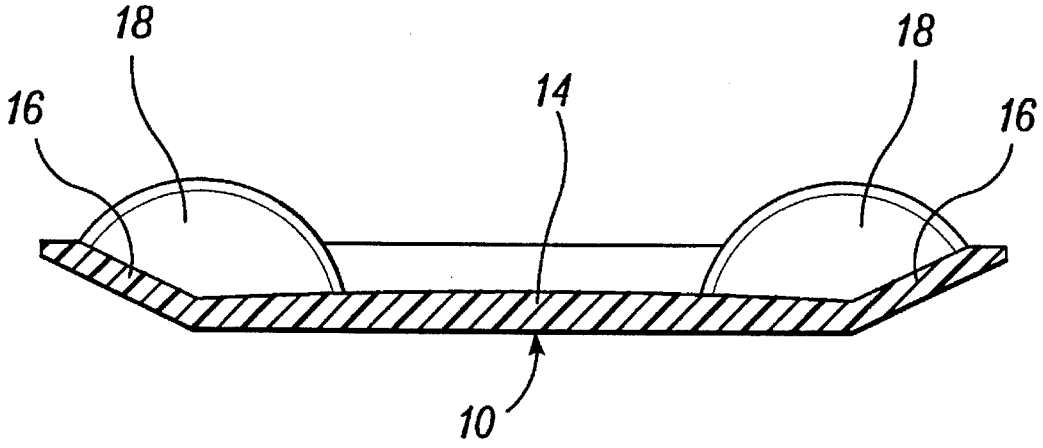
FIG. 5 is a cross-sectional side view of the lid illustrating the varying thicknesses of the different portions of the lid.

Referring to FIG. 1, a lid 10 is shown disposed within a mug 12. Lid 10 includes a circular disk-shaped central portion 14 and a flange 16 disposed around the periphery of central portion 14. Central portion 14 is preferably planar and has a diameter somewhat smaller than the inside diameter of mug 12. Flange 16 sealingly engages the inner walls of mug 12 as lid 10 is inserted within mug 12. The outside diameter of flange 16 is greater than the inside diameter of mug 12 before lid 10 is inserted within mug 12. Flange 16 is preferably constructed of a flexible food-grade commercial silicone. The flexible and resilient nature of flange 16 allows it to adapt to fit within a wide range of container diameters and adequately form a seal within the container. Alternatively, flange 16 may be constructed of a thermoplastic, a rubber-like material, or other flexible rubber-type material as long as flange 16 is flexible and resilient. Central portion 14 is also preferably constructed of a flexible organic silicone and formed integrally with flange 16. Alternately, however, central portion 14 may be constructed of a different material and be joined to flange 16. Silicone is the preferred material due to its resiliency even when subjected to heat and/or sunlight over time.

Finger tabs 18 are connected to both central portion 14 and flange 16 and provide a place for the user to grip to insert or remove lid 10 from mug 12. Preferably, tabs 18 are semicircular in shape and project vertically upward from the top surface of lid 10. In the preferred embodiment shown in FIG. 1, two tabs 18 are disposed on the top of lid 10. Alternatively, other numbers of tabs may be used.

A drinking aperture 20 and a vent aperture 22 extend through lid 10. Drinking aperture 20 is preferably positioned within flange 16, 90 degrees offset from finger tabs 18. Drinking aperture 20 is simply an oblong hole through flange 16 to allow a limited amount of liquid to pass. Vent aperture 22 is disposed 180 degrees from drinking aperture 20 within flange 16 near the junction of flange 16 with central portion 14. Alternatively, drinking aperture 20 and/or vent aperture 22 may be disposed through central portion 14. Drinking aperture 20 is disposed a sufficient distance from the cup rim to allow for proper sipping of the hot beverage. Vent aperture 22 and drinking aperture 20 permit easy consumption of the beverage, but are small enough and located in such a way to help eliminate splashes during rough travel when riding in a vehicle.

The elements of lid 10 are illustrated in more detail in FIGS. 2–5. Flange 16 forms a wide flat lower surface, which is generally in the shape of an inverted frustum of a cone. Thus, flange 16 projects outwardly and upwardly from central portion 14 at an angle of about 30 degrees. The upward and outward angle of flange 16 makes lid 10 easy to insert within containers of differing diameters. Alternatively, flange 16 may extend from central portion 14 with a decreasing angle, or an increasing angle as it extends outwardly. Flange 16 is flexible and resilient such that it can accommodate not only containers of differing diameters, but also out-of-round containers. Flange 16 is substantially flat and wide such that a large surface area comes in contact with mug 12 when inserted. The wide lower surface and flat section of flange 16 also allow lid 10 to be inserted in mugs or other containers that have downward tapers, vertical walls, or even slight upward tapers. The thickness of flange 16 preferably slightly decreases toward its outer periphery. Alternatively, the thickness of flange 16 could be greater or less than that of central portion 14. However, the thickness of central portion 14 is preferably greater, on average, than that of flange 16 to provide some rigidity to lid 10 while flange 16 remains flexible enough to accommodate and adequately engage a wide variety of containers.

Lid 10 is preferably manufactured by a transfer/compression mold process.

Figure 6:
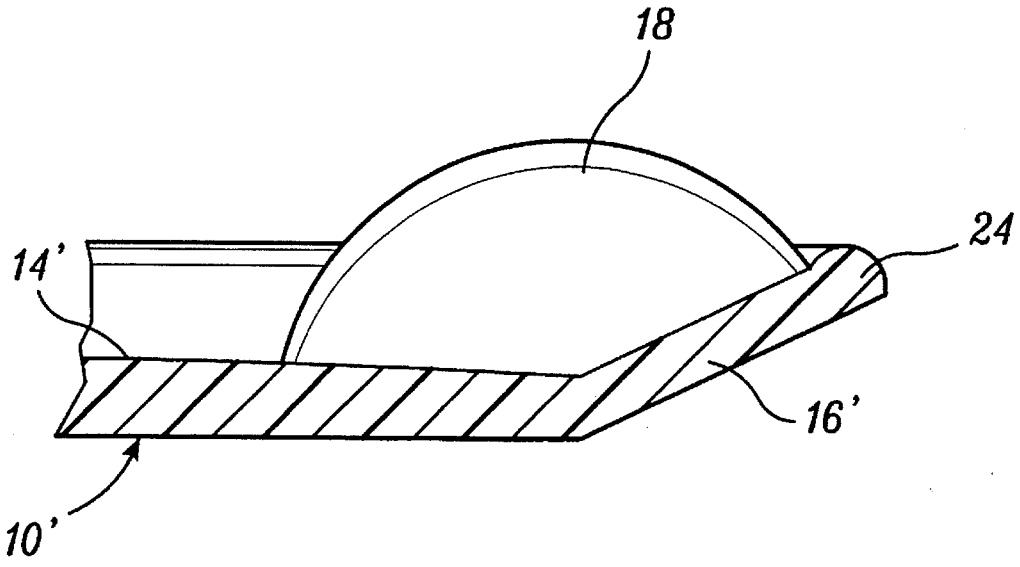
FIG. 6 is a cross-sectional side view of an alternate embodiment of the lid of the present invention that includes a flange projection.

FIG. 6 illustrates an alternate embodiment of the invention. In this embodiment, the outer periphery of flange 16' includes a flange projection 24. Flange projection 24 is formed of a small bead circumscribing flange 16'. Flange projection 24 enhances the rigidity of flange 16' for a tighter seal to the inner walls of the container. Flange projection 24 is still quite small so that containers of differing diameters may be used with lid 10' without the periphery of flange 16' buckling.

The use of lid 10 is illustrated in FIG. 1. Lid 10 is inserted within mug 12 by first placing lid 10 on top of mug 12. As discussed above, the diameter of lid 10 is greater than the inside diameter of mug 12 such that lid 10 will rest on top of mug 12. The user then exerts a downward force on central portion 14. The downward force causes flange 16 to deflect upwardly such that the outer diameter of lid 10 is reduced. The bottom surface of flange 16 becomes curved as it deflects upwardly. The user applies the downward force until lid 10 is positioned within mug 12 so that the outer periphery of flange 16 is beneath the rim of mug 12. In this position, the bottom surface of flange 16 has a portion that is flat against the inner sidewall of mug 12. This portion of flange 16 provides the sealing engagement with mug 12. Preferably, drinking aperture 20 and vent aperture 22 are not within the portion of flange 16 that engages the sidewall of mug 12. The portion of flange 16 that is not in contact with mug 12 curves downwardly and inwardly to central portion 14. Central portion 14 may also be slightly deflected downwardly such that it has a slightly concave upper surface. However, the relatively greater thickness of central portion 14 causes it to not deflect as readily as flange 16.

Due to the sealing engagement of flange 16 within mug 12, combined with the arrangement of drinking aperture 20 and vent aperture 22, the liquid within mug 12 is kept from spilling and is easy to drink on the go. If mug 12 is jarred, a small amount of liquid may exit drinking or vent apertures 20 or 22, respectively. However, due to the small size of these apertures the liquid is likely to stay contained on the top of lid 10. Also, when drinking on the go, the user need not worry about spilling the contents of mug 12. The sealing engagement of flange 16 with the inner sidewall of mug 12 allows mug 12 to be tilted without regard to the liquid level and still have the liquid controllably delivered through drinking aperture 20.

Lid 10 also provides good thermal insulation for retaining the heat of a liquid within mug 12. Only a small amount of heat is lost through drinking and vent apertures 20 and 22, respectively. The silicone material of which lid 10 is constructed has good insulation properties. Also, the thickness of central portion 14, which covers most of the upper opening of mug 12, adds to the heat-retentive quality of lid 10.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A closure for preventing liquid spills from a drinking container having an inside surface, said closure comprising a generally concave disk having an upper surface and a lower surface, said concave disk comprising:

(a) a resilient central portion bendable in any direction such that said central portion may increase in concavity to securely fit into the drinking container;

(b) an angled flange extending upwardly and outwardly from central portion around the periphery of said central portion, said flange having an upper surface and a lower surface, said flange having free outer edges and being flexible and resilient, the outer edges of said flange having a thickness less than that of said central portion and being free to flex inwardly, said lower surface of said flange having the shape of an inverted frustum of a cone for sealingly engaging the inside surface of the drinking container;

(c) a drinking hole offset from the center of said disk and a vent hole offset from the center of said disk approximately opposite said drinking hole; and (d) a disk removal means attached to the top of said central portion and said flange for aiding in the removal of the disk from the drinking container.

2. The closure of claim 1, wherein said removal means comprise at least one finger tab.

3. The closure of claim 1, wherein the disk has a circular outer shape.

4. The closure of claim 1, wherein the average angle between said angled flange and a plane substantially containing said central portion is less than about 30°, said angled flange being wide enough to adapt to a wide range of drinking containers.

5. A lid for drinking containers having inner sides, said lid comprising:

(a) a disk having a single upwardly turned rim all around the disk, said rim being a wide thin flange having a smooth lower surface with free outer edges that are inwardly flexible toward a center axis of said disk, said flange being wide to accommodate various sizes and shapes of containers, said rim being flexible and resilient for sealingly engaging the inner sides of the drinking container, said outer edges of said flange extending upwardly and outwardly to be adaptable to various sizes and tapers of drinking containers; said disk having a drinking aperture extending through said disk offset from the center of said disk and a vent aperture extending through said disk offset from the center of said disk and on an opposite side of said disk from said drinking aperture; and (b) disk removal means disposed on the top of said disk partly attached to said flange to aid in removal of said disk from the drinking container.

6. The lid of claim 5, wherein said rim is constructed of a material including at least silicone.

7. The lid of claim 5, wherein said disk includes a generally flat central portion and wherein the lower surface of said rim has the shape of an inverted frustum of a cone, the angle between a plane substantially defined by said central portion and said rim being less than about 30°.

8. The lid of claim 1, wherein said central portion is resiliently bendable upwardly around substantially all of its periphery such that said central portion may increase in concavity to accommodate drinking containers of various diameters and tapers.

9. The lid of claim 5, wherein the outer periphery of said disk has a circular shape.

10. An enclosable drinking container comprising:

(a) a drink receptacle having an inner sidewall;

(b) a lid including a disk having an upwardly and outwardly turned rim, said rim being a wide thin flange having a resilient lower surface, wherein the width of said rim accommodates various sizes and shapes of containers, said rim being flexible and resilient and having outer edges that are thinner than the center of said disk and are inwardly flexible for sealingly engaging said inner sidewall of said drink receptacle, the angle between a plane substantially along the center of said disk and said rim being less than about 30°; said disk having a drinking aperture extending through said disk offset from the center of said disk and a vent aperture extending through said disk offset from the center of said disk and on an opposite side of said disk from said drinking aperture; and (c) disk removal means disposed on the top of said disk partly attached directly to said flange to aid in removal of said disk from the drinking container.

11. The lid of claim 10, wherein said rim is constructed of a material including silicone.

12. The lid of claim 10, wherein the lower surface of said rim has the shape of an inverted frustum of a cone.

13. The lid of claim 10, wherein the outer periphery of said disk has a circular shape.

* * * * *

UNITED STATES PATENT AND TRADEMARK OFFICE

CERTIFICATE OF CORRECTION

PATENT NO. : 5,553,731

DATED : September 10, 1996

INVENTOR(S) : R.D. Schuyler

It is certified that error appears in the above-indentified patent and that said Letters Patent is hereby corrected as shown below:

| COLUMN | LINE | |
|---|---|---|
| 6 (Claim 8, line 1) | 6 | "of claim 1" should read --of claim 7-- |

Signed and Sealed this

Fourth Day of February, 1997

*Attest:*

*Attesting Officer*

BRUCE LEHMAN

*Commissioner of Patents and Trademarks*